United States Patent [19]

Sawai et al.

[11] Patent Number: 4,527,507

[45] Date of Patent: Jul. 9, 1985

[54] SPRAY APPARATUS FOR APPLYING A SHARP-EDGED PATTERN OF COATING

[75] Inventors: Katsumi Sawai; Koichi Komon; Isamu Matsuoka; Hidemi Tonobayashi; Masaaki Fujimura, all of Suzuka; Shiro Ito, Kawasaki; Shuichi Seino, Hirakata, all of Japan

[73] Assignee: Honda Giken Kogyo Kabushiki Kaisha, Tokyo, Japan

[21] Appl. No.: 628,344

[22] Filed: Jul. 6, 1984

[30] Foreign Application Priority Data

Jul. 13, 1983 [JP] Japan ..... 58-127197

[51] Int. Cl.[3] ..... B05B 7/06; B05C 5/00

[52] U.S. Cl. ..... 118/314; 118/315; 118/301; 239/290; 239/291; 239/299; 239/601

[58] Field of Search ..... 118/314, 315, 301; 427/286; 239/290, 291, 292, 295, 299, 601, 597, 599

[56] References Cited

U.S. PATENT DOCUMENTS

| | | | |
|---|---|---|---|
| 2,088,542 | 7/1937 | Westin | 239/290 X |
| 2,613,634 | 10/1952 | Johns et al. | 118/315 |
| 3,848,807 | 11/1974 | Partida | 239/290 |
| 4,073,839 | 2/1978 | Burkholder | 239/597 X |
| 4,236,674 | 12/1980 | Dixon | 239/299 X |

*Primary Examiner*—Shrive P. Beck

*Attorney, Agent, or Firm*—Burgess, Ryan & Wayne

[57] ABSTRACT

A spray apparatus is disclosed which is capable of producing a sharp-edged layer of coating in overlap over the surfaces coated in a different color so as to provide a distinctly divided two-tone pattern of wide dimensions without using masking tape. The spray apparatus comprises a first spray means and at least one second spray means different in nozzle design from the first spray means. In the first spray means, a film of coating is produced by an airless type paint discharge nozzle discharging a spray of atomized paint under pressure in an otherwise conical shape which is to be altered in spray formation by a jet of pressurized air whose axis is offset from the axis of the spray of paint and this film is thick enough along one edge and in the center while decreasing in coating toward the opposite edge. In the second spray means, the spray of atomized paint is shaped into a symmetrical cone by a controlled jet of pressurized air, with the resultant film of coating being thick enough in the center and decreasing in thickness toward both edges. The first and second spray means are spaced apart from operation such that the entire coated area will come as a layer of uniform coating, with the opposing edges of the films overlapping to provide a coating as thick as in their center portions.

7 Claims, 6 Drawing Figures

SPRAY APPARATUS FOR APPLYING A SHARP-EDGED PATTERN OF COATING

BACKGROUND OF THE INVENTION

The present invention relates generally to a coating apparatus used for producing two-tone patterns and more particularly to spray apparatus for applying a sharp-edged layer of coating.

When spraying is used to produce a sharp-edged film of coating in overlap over the surfaces, which may already be painted in a different color, of automobile bodies for example, so as to decorate them in two-tone design, it is considerably difficult to make sharply demarcated that edge of the film which is bounded on the adjacent differently colored area because portions of the sprayed paint particles flying across the boundary line to settle in the adjacent area. Various techniques have been used conventionally to obviate this problem. One method is to apply masking tape of suitable width along the dividing line on the side of the adjacent area that should not be sprayed. Another is to completely cover the adjacent area, exposing alone the surface to be sprayed. In either of these methods, desired effects have been obtained in preventing the masked area from being smeared with flying sprayed particles. However, these prior art methods have been found to pose problems. First, processes involved are in themselves not very efficient in actual practice and also not suitable for applications of conveyor-type line production. Second, the subsequent removal of the masking tape tends to cause the jagging of that edge of the film of coating which borders on the tape, since the removal is to destroy the coating of sprayed paint dried in a single layer across the surface of the tape. In other instances, this removal can entail the scraping of flakes off the layer along the edge of the film where the paint is not fully dried, together with the tape.

SUMMARY OF THE INVENTION

The present invention has for its object to provide a unique spray apparatus for use in producing distinctly divided two-tone layers of coating without use of the conventional masking tape.

Another object of this invention is to provide such a spray apparatus suitable for use in providing two-tone layers of coating of wide area.

In one preferred embodiment of the present invention, the spray apparatus comprises a first spray means capable of enabling a spray of atomized paint under pressure discharged in an otherwise conical shape which is to be altered in shape by a jet of pressurized air discharged having its axis offset from that of the paint spray and a second spray means which is designed to enable a spray of atomized paint under pressure discharged in a conical shape to be controlled by a jet of pressurized air discharged in a symmetrical conical shape. When this spray apparatus is operated to produce a film of coating, the film produced by the first spray means is thick enough in coating along its one edge and in the center while progressively lessening in thickness toward the opposite edge, whereas the film painted by the second spray means is thick enough in coating in the center while progressively lessening in thickness toward both edges of the film. The distance between the first and second spray means is such that the film by the former overlaps, along its edge coated in gradually decreasing thickness, with a portion of the similarly coated edge of the film by the latter, so that the entire area comprising both films will become uniform in coating. In practice, the first and second spray means are placed in a fixed position in front of the surface to be coated which is moved in one direction relative therewith, and are spaced apart in the direction perpendicular to the direction of movement of the surface. The entire film of coating provided by this spray apparatus without using the conventional masking tape is uniform in thickness and is sharply defined along that edge of the film which borders on the adjacent area pre-coated in a different color.

DETAILED DESCRIPTION OF THE PREFERRED EMBODIMENTS

Figure 1:
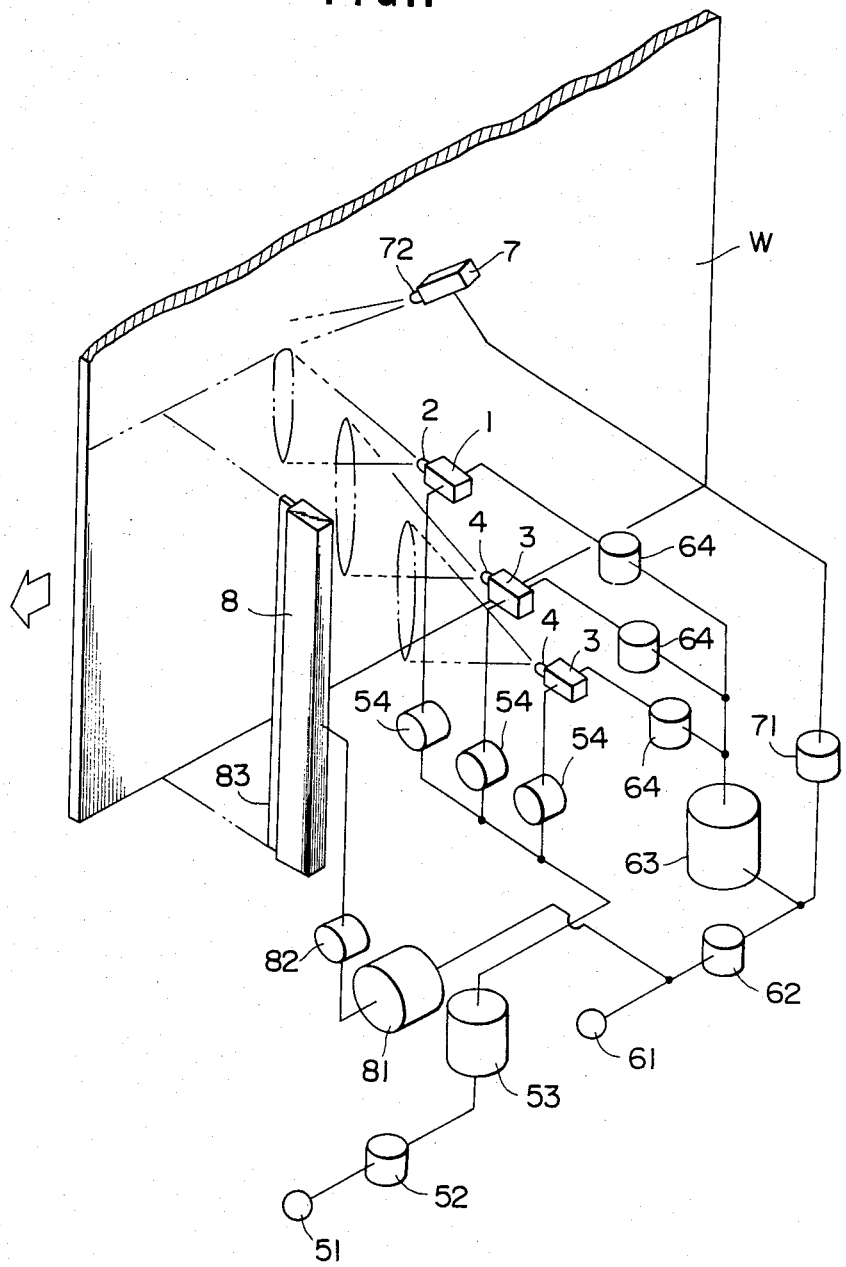
FIG. 1 is a schematic view of a typical embodiment of the spray apparatus according to the present invention.

FIG. 1 illustrates in schematic form a typical embodiment of the spray apparatus constructed in accordance with the present invention. This embodiment comprises a first spray 1 and at least two second sprays 3, 3 of substantially similar construction. The first spray 1 has a spray nozzle 2 that is designed to apply in spray a layer of coating with concentrated distribution of paint thick enough for a clear demarcation along its one edge against the adjacent area precoated in a different color. Each of the second sprays 3, 3 comprises a spray nozzle 4 that is designed to produce in spray a film gradually thinned toward both edges of the film. The first and second sprays 1, 3, 3 are mounted fixedly on a stationary frame (not shown), each facing equidistantly at relatively close range the surface W to be coated that is mounted on a conveyor means (not shown) for movement parallelly with the frame in the direction of the arrow. The sprays 1, 3, 3 are preferably arranged vertically one above another (or perpendicular to the direction of movement of the surface W), properly spaced apart so as to accommodate the width of the surface W. Also, the sprays 1, 3, 3 are preferably staggered laterally or offset from one another so that, since they discharge paint at the same time in operation, their fans of spray would not interfere with one another. Each of the sprays 1, 3, 3 is connected to a common pump 51 which delivers thereto paint under pressure, at several multiples of 10 kg/cm$^2$, for instance. Provided in the paint supply line are a main pressure regulator 52 for pressure control of paint and a temperature regulator 53 with a built-in heater for temperature control of paint. Preferably, each spray 1, 3, 3 may be provided with a respective pressure regulator 54 installed upstream of the spray for independent pressure control. Also, each of the sprays 1, 3, 3 is connected to a common source of pressurized air 61 which supplies thereto air under relatively low pressure, at several multiples of 1 kg/cm$^2$ for example. Provided in the air line are a main pressure regulator 63, and, preferably, a respective pressure regulator 64 for overall and independent pressure control.

A jet blower 7 is provided for placement facing the surface W in an inclined position at such a height above the first spray 1 that the jet of pressurized air from a discharge nozzle 72 is directed from above toward the film of coating sprayed by the first spray 1 along that edge of the film which defines the dividing line between the area to be coated and the adjacent area which should not be sprayed, blowing back and thereby keeping the paint particles sprayed inside of the dividing line. The jet blower 7 may be connected to the air source 61 through a pressure regulator 71 that is provided for pressure control of air to the nozzle 72. To dry quickly the paint sprayed by the sprays 1, 3, 3 in the surface W, provided is a drier 8 which discharges a jet of dried air through a nozzle 83 with an discharge orifice of elongated shape. The longitudinal length of this discharge orifice may preferably be selected to suit the entire width of the coated area. Also, the drier 8 is connected to the pressurized air source 61 for supply of pressurized air and may preferably be provided in the air line with an air conditioner 81 equipped with either or both of a heater and a dehumidifier for removal of moisture from the air to the drier 8. In addition, a pressure regulator 82 may preferably be installed in the air line for pressure control of air.

Figure 3:
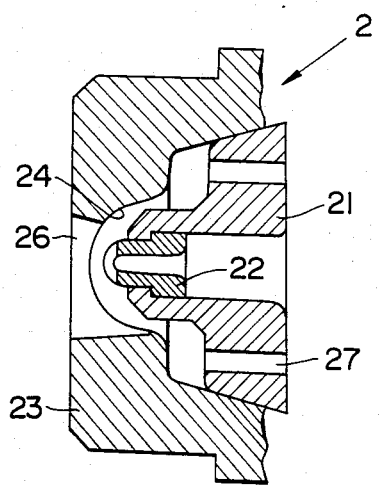
FIG. 3 is a cross-sectional view of the discharge nozzle of the first spray means of the spray apparatus.
Figure 4:
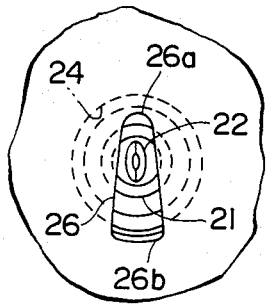
FIG. 4 is a front view of the nozzle of FIG. 3, depicting its important portion.

FIGS. 3 and 4 show respectively a preferred embodiment of a nozzle 2 suitably designed for installation in the first spray 1. The nozzle 2 comprises a paint spray nozzle 22 having an orifice designed to produce a cone-shaped spray and an air nozzle 23. The paint spray nozzle 22 may preferably be built of a hard material such as hard metal or ceramic. The orifice of the nozzle 22 has an elongated lip shape, as best shown in FIG. 4. The paint spray nozzle 22 is press-fit into a holder 21 that is held in fixed position within the air nozzle 23 which will be described in detail hereunder.

The air nozzle 23 is formed with a domed cavity 24, as best shown in FIG. 3, that encloses substantially concentrically the paint discharge nozzle 22, which extends its tip inside the cavity 24, the orifice of the nozzle 22 being formed to open into it.

Moreover, the air nozzle 23 is formed with an orifice 26 of a generally elongated triangular shape, as shown in FIG. 4, whose wall extends inside to be merged into the wall of the domed cavity 24 and which is in communication with an air passage 27 formed within the holder 21. The orifice 26 is situated in offset or eccentrically from the axis of the paint discharge nozzle 22, with the narrow top end of the orifice 26 closer the nozzle 22 than the wide bottom end, as best shown in FIG. 3. This particular shape of the air jet discharged by the air nozzle 23 is selected to cause the spray of atomized paint discharged from the nozzle 22 to alter in shape, i.e., by the effect of the force in the irregularly converged air streams, so that the film of coating resulting from the paint sprays will come thick enough along one side of the film for a shape-edged demarcation against the adjacent area of a different color.

Figure 5:
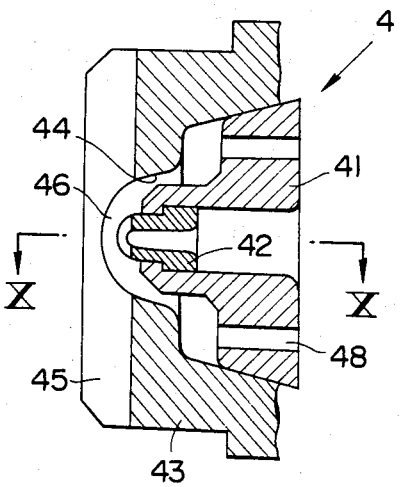
FIG. 5 is a cross-sectional view of the discharge nozzle of the second spray means of the spray apparatus.
Figure 6:
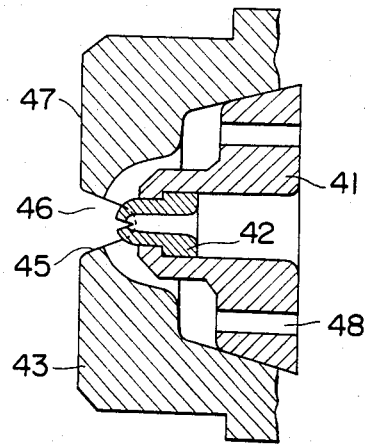
FIG. 6 is a cross-sectional view taken along line X—X of FIG. 5.

FIGS. 5 and 6 illustrate respectively a preferred embodiment of a spray nozzle 4 that is designed for proper installation in the second spray 2. Similarly, the nozzle 4 comprises a paint discharge nozzle 42 made also of hard material with a central discharge orifice, an axially extending holder 41, and an air nozzle 43 that is situated to substantially concentrically enclose the nozzle 42. Each of the nozzles 42 and 43 are designed to discharge a spray in a conical shape. A domed cavity 44 is formed within the air nozzle 43 and cut at its top to open into a V- or U-shaped transverse groove 45, as shown in FIG. 6, thereby constituting the discharge orifice 46 of the nozzle 4 at its front face 47. The tip of the paint nozzle 42 is lip-shaped and is in communication with the domed cavity 44. Air that is supplied from the air source 61 through an air passage 48 formed within the holder 41 is discharged under relatively low pressure through the domed cavity 44. With the above arrangement, when the second spray 3 is started in operation, since the paint discharge nozzle 42 is enclosed concentrically by the air nozzle 43, the spray of paint discharged from the paint nozzle 42 is controlled into a symmetric conical form by the air jet produced by the air nozzle 43.

Figure 2:
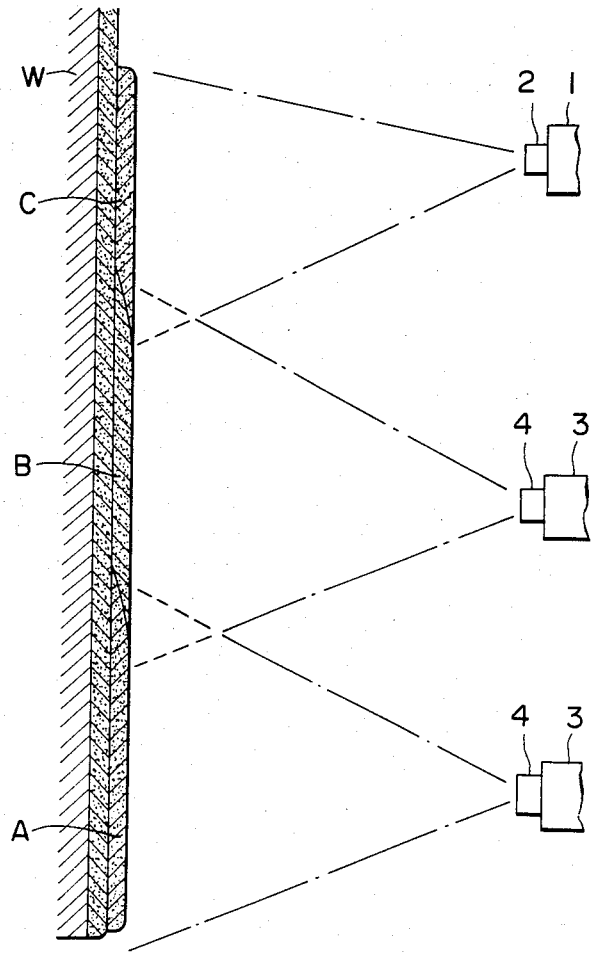
FIG. 2 is a cross-sectional view of a layer of coating produced by the spray apparatus of this invention.

The coating process by the above-mentioned spray apparatus will be described in more detail with respect to FIGS. 1 and 2.

Preferably, the arrangement may be such that the nozzles 2 and 4 respectively of the sprays 1 and 3 are placed to spray to the area to be coated at closer range (at a distance of a maximum of 20 cm, for example) than in conventional spray coating, with the surface W being moved in the direction of the arrow (FIG. 1).

Operation of the lower second spray 3 will first be described. The air jet discharged in a conical shape by the air nozzle 43 through the orifice 46 serves to promote further atomization of the spray of paint produced by the paint discharge nozzle 42 while controlling the spray, shaping it into a more convergent distribution so that the film of coating A formed in the surface W would comprise a layer coated in decreasing thickness toward its both edges.

The upper second spray 3 that is provided to extend parallelly with the upper second spray 3 produces in operation the same effect as the latter, with the resultant film B of coating being similar in structure to the film A. Accordingly, description of its operation is omitted here for brevity's sake. However, it should be noted that the distance between upper and lower second sprays 3, 3 is such that the film B produced by the former overlaps, along its lower edge coated in gradually reducing thickness, with a portion of the similarly coated upper edge of the film A sprayed by the latter, making this overlapped area as thick in coating as the center portions of the films A and B, so that the entire area throughout both films will come as a uniformly coated layer. In this case, the lower second spray 3 must be situated adjacent to the bottom edge of the area to be coated, such that this edge will be coated thick enough by the center part of the spray produced by the second spray 3.

Then, operation of the first spray 1 will be explained. When the first spray 1 is operated to cause the paint discharge nozzle 22 to discharge a spray of paint in a conical shape under pressure, at several multiples of 10 $kg/cm^2$ for example, and the air nozzle 23 to produce through the orifice 26 a jet of air under pressure, at several multiples of 1 $kg/cm^2$ for example, at the same time, the spray of atomized paint that will otherwise be conical in shape is forced to take a special pattern of distribution by the effect of the air jet that is eccentric or offset from the axis of the paint spray, due to the configuration and position of the orifice 26 of the air nozzle 23 relative to the paint nozzle 22. In other words, with respect to FIG. 4, the air jet from the air nozzle 23 is greater in velocity and consequently in velocity head with a greater degree of directively occurring at 26*a* where the wall of the orifice 26 is closer to the axis of the paint discharge nozzle 22 than at 26*b* where the wall is remote from the axis. This irregular velocity distribution in the air jet results in the formation of a film of coating from the paint spray which is thick enough in the center portion and along that edge of the film where a greater concentration of atomized paint particles occurs by the effect of the air jet passing through the narrowest part of the orifice 26. This film gradually decreases in thickness toward the opposite edge where the paint particles are distributed over a wider area by the air jet passing through the widest part of the orifice 26. The film of coating C thus obtained will emerge distinct along the edge against the adjacent area pre-coated in a different color on which that edge borders. Also, the distance between the first spray 1 and upper second spray 3 is such that the film C produced in the surface W by the former overlaps, along its lower edge coated in progressively reducing thickness, with a portion of the upper similarly coated edge of the film B sprayed by the latter. Consequently, the entire coated area (i.e., comprising all of the films A, B, and C produced by the sprays 1, 3, 3 in conjunction) will form a layer of uniform coating.

The sprays 1 and 3 are started in actual operation to spray paint in a continuous manner as the surface W is moved. The number of second sprays 3 for simultaneous operation with the first spray 1 may be increased according to the desired width of the area to be coated. The provision of the drier 8 is useful to quickly dry the coating.

In a more preferred embodiment, the first and second sprays 1, 3 are movably mounted on a stationary frame (not shown) to permit change of positions so that their spacing can be increased or decreased according to the requirements of various purposes. Also, each of the sprays 1 and 3 may preferably be designed such that their discharge nozzle can be adjusted to a desired angle of discharge. One or more of the pressure regulators 54, 64 which is preferably adapted for pressure control of air and paint to be sprayed may be adjusted to accommodate the desired thickness or width of the film of coating.

What is claimed is:

1. A spray apparatus for applying a sharp-edged layer of coating in overlap over surfaces pre-coated in a different color for producing a sharply divided two-tone pattern, comprising a first spray means designed to enable a spray of atomized paint discharged under pressure in an otherwise conical shape which is to be altered in spray formation by a jet of pressurized gas discharged in a conical shape having its axis placed in offset from the axis of said spray of atomized paint and at least one second spray means mounted to extend parallelly with said first spray means and designed to enable a spray of atomized paint discharged under pressure to be converged into a symmetrical spray formation by a jet of pressurized gas having its axis at the same point as said spray of atomized paint discharged by said second spray means, said first spray means being situated externally of said second spray means at a point where the film of coating produced on a surface having an area pre-coated in a different color bordering on the area to be coated from said spray of atomized paint that is discharged by said first spray means, has its outer edge bordering on said pre-coated area, the distance between said first and second spray means being such that said film produced on said surface by said first spray means overlaps, along its inner edge opposite to said outer edge, with a portion of the opposing edge of the film of coating produced from said spray of atomized paint by said second spray means.

2. The spray apparatus as set forth in claim 1, wherein said first and second spray means are mounted fixedly for operation in front of said surface which is moved relative to the positions of said first and second spray means.

3. The spray apparatus as set forth in claim 1, wherein said first and second spray means are spaced apart in the direction of movement of said surface by a distance sufficient to accommodate the desired width of coating sprayed on said surface.

4. The spray apparatus as set forth in claims 1 and 3, wherein said first and second spray means are laterally staggered such that the sprays of atomized paint discharged by the two sprays will not interfere with each other.

5. The spray apparatus as set forth in claim 1, wherein a jet blower is mounted at a point externally of said first spray means and is adapted to produce a jet of pressurized gas which is directed to force back and so keep the paint particles, which may otherwise fly across said outer edge of said film of coating that is produced by said first spray means inside of the dividing line between said outer edge and said area pre-coated in a different color.

6. A spray apparatus for applying a sharp edged layer of coating in overlap over surfaces pre-coated in a different color for a distinctly divided two-tone pattern, comprising a paint discharge nozzle designed to discharge a spray of atomized paint under pressure in a conical shape and a gas discharge nozzle designed to a jet of pressurized gas from an orifice shaped to enclose said paint discharge nozzle and having its axis placed in offset from the axis of said paint discharge nozzle.

7. The spray apparatus as set forth in claim 6, wherein said first spray means has a gas discharge nozzle having an orifice having a generally elongated triangular shape through which said spray of paint is discharged and a paint discharge nozzle adapted to discharge said jet of air, said orifice of said gas discharge nozzle being formed so as to have its top narrow end nearer said paint discharge nozzle than the bottom wide end.

* * * * *